United States Patent [19]

Woods et al.

[11] 4,248,032

[45] Feb. 3, 1981

[54] BAGGING APPARATUS

[75] Inventors: Quentin T. Woods; William D. Gerverdinck, both of San Jose, Calif.

[73] Assignee: FMC Corporation, San Jose, Calif.

[21] Appl. No.: 48,106

[22] Filed: Jun. 13, 1979

[51] Int. Cl.[3] ..... B65B 43/34; B65B 43/30

[52] U.S. Cl. ..... 53/570; 53/257; 53/258; 53/261; 53/386

[58] Field of Search ..... 53/570, 571, 257, 258, 53/260, 261, 384, 385, 386

[56] References Cited

U.S. PATENT DOCUMENTS 3,566,576 3/1971 Ayres et al. ..... 53/570 X

FOREIGN PATENT DOCUMENTS 2331483 7/1977 France ..... 53/258

*Primary Examiner*—Travis S. McGehee
*Attorney, Agent, or Firm*—R. S. Kelly; T. J. McNaughton; J. F. Verhoeven

[57] ABSTRACT

An apparatus for inserting a carton into a thermoplastic bag includes a table for supporting the bag, a pusher assembly for transferring a carton into the bag, and a guide assembly for first opening the bag mouth and for thereafter guiding the carton into the mouth of the bag while supporting the carton above the table until after it has been fully inserted into the bag. A vacuum is applied through apertures formed in the table to initially hold the bottom panel of the bag against the table, and a reciprocatable suction cup assembly is mounted above the suction apertures for engaging the top panel of the bag and for partially opening the mouth of the bag so that the guide assembly may be inserted therein. The guide assembly includes upper and lower guide members which are conjointly moved into the partially opened mouth of the bag, and thereafter the upper guide member is elevated to spread the mouth of the bag and engage the mouth of the bag so as to cooperate with the lower guide member to retain the bag as the carton is subsequently pushed therein. The guide members are long enough to support the leading end of the carton above the table until the carton bottoms out in the bag, thereby assuring that the bag is not caught and hence damaged between the carton and the bag table.

4 Claims, 9 Drawing Figures

BAGGING APPARATUS

BACKGROUND OF THE INVENTION

1. Field of the Invention

The present invention generally relates to apparatus for inserting an article into a bag, and more particularly, it concerns apparatus for inserting a relatively rigid and bulky article, such as a carton, into a flexible bag.

2. Description of the Prior Art

Bagging apparatus have been provided for inserting items such as sliced bread, rolls and other bakery goods into thermoplastic bags at relatively high production rates. One known type of bagging apparatus for packaging sliced bread loaves in thermosplastic bags includes a wicket holder which supports a stack of bags adjacent the side of a belt conveyor, an air injector for partially spreading the mouth of the top bag in the stack, a stop member which engages one end of a bread loaf, and a scoop assembly for first fully spreading the mouth of said top bag and thereafter pulling such bag over the bread loaf while the loaf is engaged against the stop member. The scoop assembly includes a pair of upper and lower guide members, or scoops as they are known in the packaging art, which scoops are concavely contoured to receive the top and bottom of the loaf. The scoops are mounted to a scoop drive assembly so that they may first be moved, while in a closely vertically spaced arrangement, into the partially opened mouth of a bag to an extent such that the leading ends of the scoops abut against the closed end of the bag and further yet so as to tear the bag from the portion thereof engaged by the wicket holder. After such insertion, the upper scoop is elevated by a cam-operated drive assembly to spread the bag mouth into a shape suitable for receiving the loaf. With the bag engaged on the scoops, the scoops are retracted to draw the lower and upper scoops respectively under and over the loaf while the loaf is held in place by the stop member so as to cause the loaf to slide into the bag on the lower scoop. The scoops are retracted to the extent that the bag, having the loaf therein, is pushed off the scoops.

SUMMARY OF THE INVENTION

The present invention concerns an apparatus for inserting a generally bulky, relatively rigid article, such as a carton, into a flexible bag, wherein a guide assembly is arranged to be stationarily engaged within the mouth of the bag so as to support the article as it is pushed into the bag.

The bagging apparatus includes a table for supporting the bag and a platform for supporting the article to be bagged in a position which is longitudinally aligned with the bag but at a higher elevation than the table on which the bag rests. A pusher assembly is provided for transferring the article from the platform into the bag. The mouth of the bag is first partially opened and is thereafter spread fully open by the insertion of the guide assembly into the bag mouth. The guide assembly includes upper and lower guide members which are shaped to slidably receive the upper and lower faces of the article to be bagged. The guide members are mounted to a carriage for conjoint longitudinal movement with the upper guide member also being mounted for separate travel along a path away from the lower guide member. After the mouth of the bag has been partially opened, the carriage is advanced to insert the guide members into the bag. Then the upper guide member is elevated to an extent such that the mouth of the bag is firmly engaged on the outer surfaces of the guide members. Then, the pusher assembly is actuated to transfer the article through the guide members into the bag. The guide members are elongated and are inserted deep enough into the bag so as to support the leading end of the carton above the bag table until the carton has been fully inserted into the bag.

DESCRIPTION OF THE PREFERRED EMBODIMENT

Figure 1:
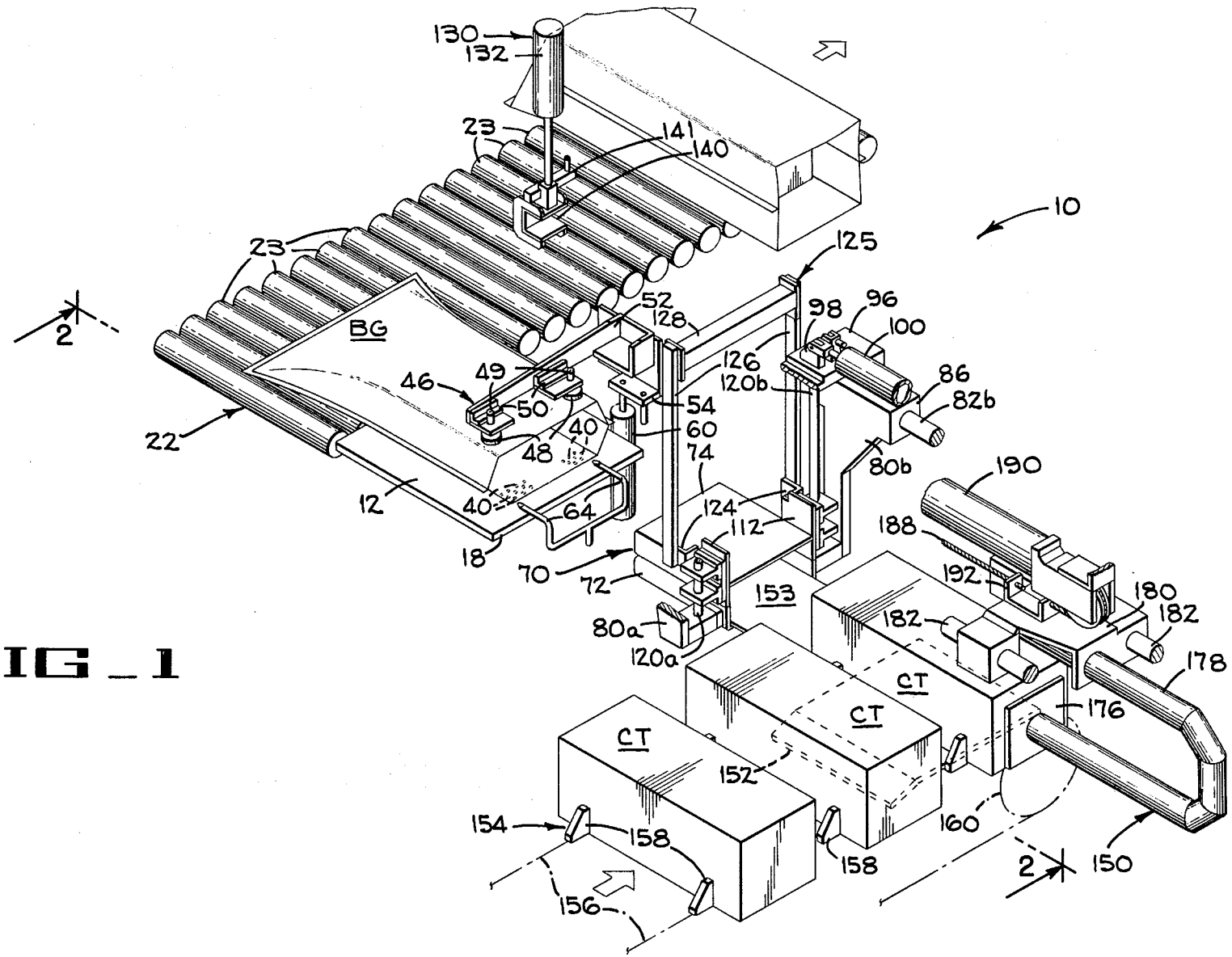
FIG. 1 is a fragmentary, diagrammatic perspective view of the apparatus of the present invention with a bag being shown held in a partially opened configuration in preparation for the insertion of the guide members.
Figure 2:
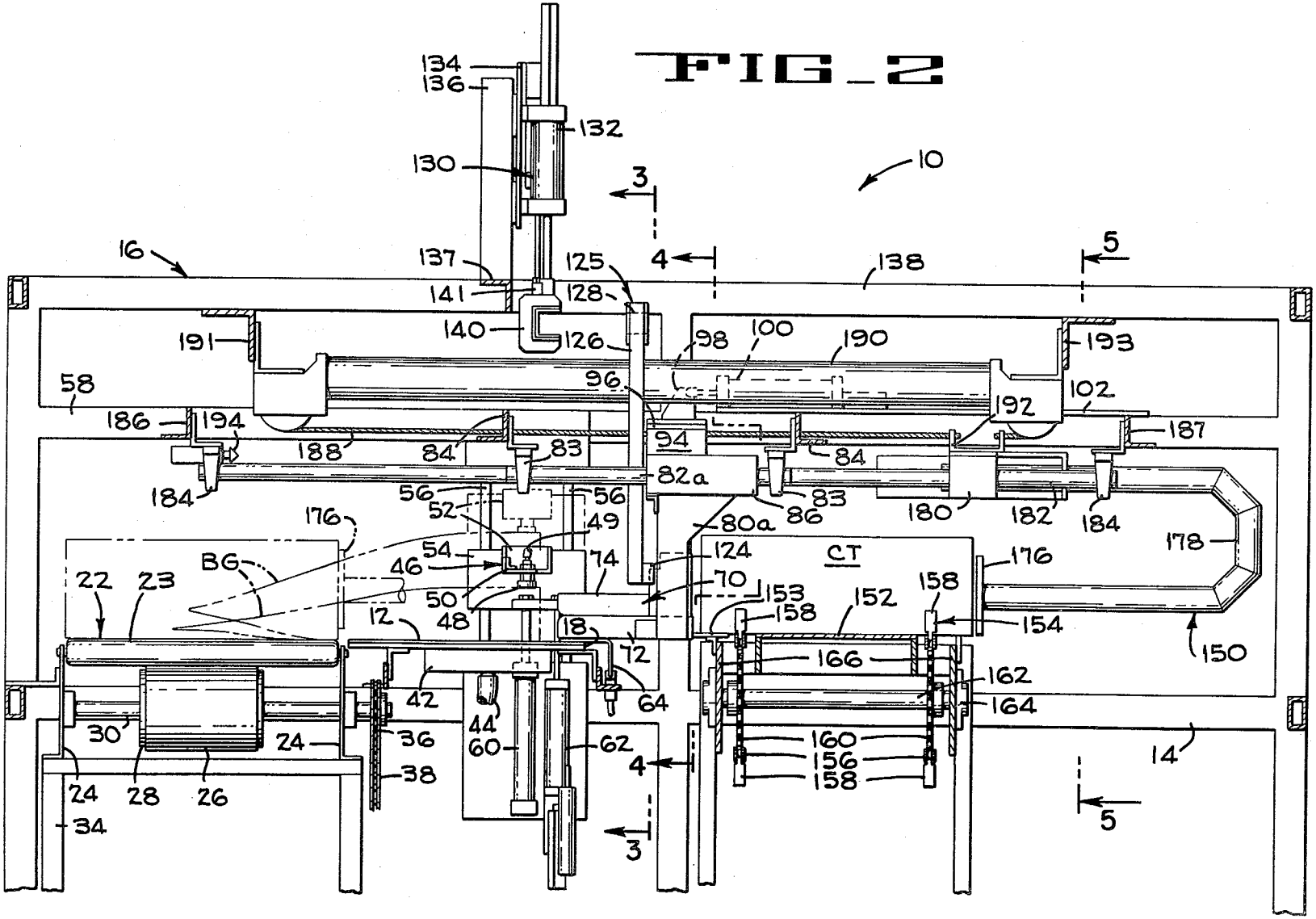
FIG. 2 is a vertical section through the bagging apparatus of the present invention taken generally on line 2—2 in FIG. 1.

As shown in FIGS. 1 and 2 and as will be hereinafter described in detail, the improved bagging apparatus 10, which is particularly adapted to insert cartons CT into bags BG, generally includes a support frame 16 (FIG. 2), a horizontal platform 12 for receiving a bag BG, an assembly 70 including lower and upper guide members 72 and 74 for first spreading the mouth of the bag and for thereafter slidably guiding the insertion of a carton into the bag, and an assembly 150 for pushing the carton from another platform 152 (FIG. 2) through the guide members and into the bag. To facilitate the operation of the bag spreading and carton guiding assembly 70, suction is selectively applied through apertures 40 (shown in dotted lines in FIG. 1) formed through the front end of the platform 12, and an elevatable suction cup assembly 46 is provided thereabove for partially opening the bag mouth. A delivery conveyor 154 is provided for transferring cartons to the platform 152. Also, a take-away conveyor 22 is provided adjacent the rear end of the platform 12 for receiving and carrying away bags having cartons inserted therein.

As shown in FIG. 2, the take-away conveyor 22 is a conventional roller-conveyor and includes a series of rollers 23 rotatably supported between a pair of side plates 24 mounted to a frame 34. A drive belt 26 engages the undersides of the rollers 23 for driving them which belt is entrained on a drum 28 that is received on a drive shaft 30. The drive shaft is received in bearings supported by the side plates 24. A drive sprocket 36 is fixed to one end of the drive shaft and is driven by a chain 38 which is selectively powered by a suitable motor (not illustrated). The take-away conveyor 22 and the platform 12 are horizontally aligned and together support the bag BG in a position such that a carton CT may be inserted therein.

At the start of a bagging sequence, a bag BG is positioned on the platform 12 and conveyor 22 such that the bag is longitudinally aligned with the carton pushing assembly 150. The bags may be individually and sequentially fed into position on the platform 12 from a stack of bags by means of a conventional sheet feeding device (not shown) such as, for example, shown in U.S. Pat. No. 4,006,704 to Perondi. Once the bag is in position on the platform 12 suction is applied through the apertures 40 in the platform to hold the mouth end of the bag to the platform. As shown in dotted lines in FIG. 1, the suction apertures 40 are formed in a pair of rectangular patterns through platform 12 adjacent the front end thereof. A pair of manifolds 42 (FIG. 3) are secured to the bottom of the platform below the apertures 40. Partial vacuum is selectively supplied to the manifolds through vacuum hoses 44 (one only shown in FIG. 2) which are connected to the bottoms of the manifolds. When vacuum is selectively applied to the manifolds 42 (by conventional control means—not shown) the bottom panel of a bag will be held against the front end of the platform 12 by the suction applied through the apertures 40 as shown. The vacuum is removed after the bag has been lifted from the platform 12 by the suction cup assembly 46, as will be described.

Figure 3:
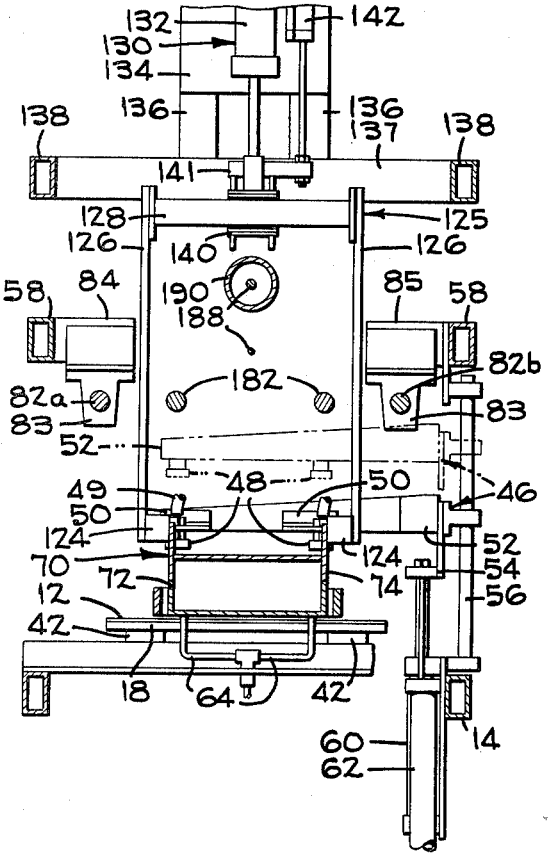
FIG. 3 is a section taken on the line 3—3 of FIG. 2, with the fully elevated position of the suction cup assembly being shown in phantom outline.
Figure 7:
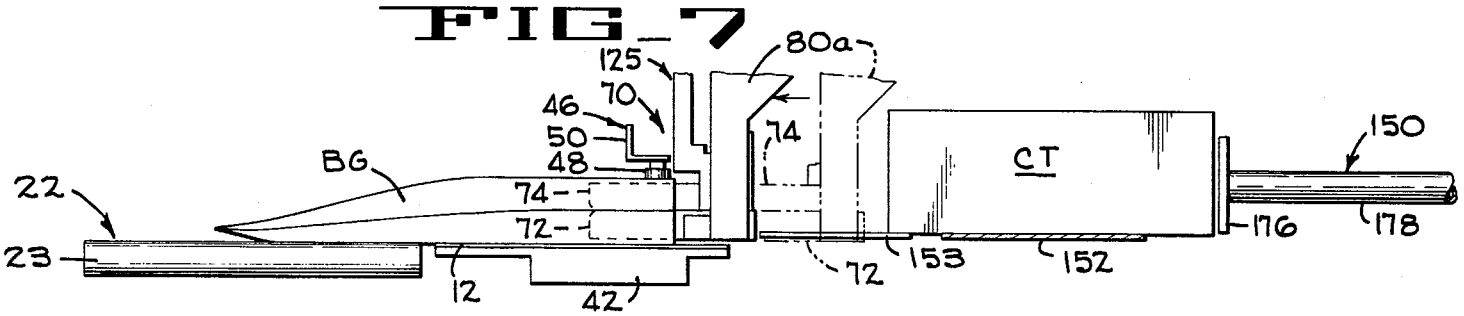
FIGS. 7–9 are diagrammatic side elevations illustrating the operation of the improved bagging apparatus of the present invention.
Figure 8:
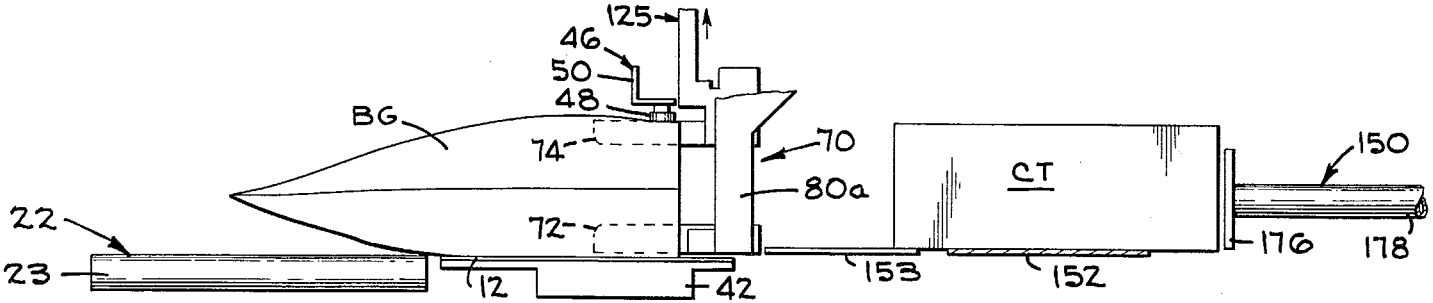

The suction cup assembly 46 for partially opening the mouth of the bag is mounted overhead above the patterns of apertures 40. The assembly 46 includes a pair of rubber suction cups 48 which vertically depend from brackets 50 mounted to an arm 52. The suction cups 48 are connected by vacuum hoses 49 to a vacuum source (not illustrated), and the application of a vacuum (by conventional control valves) to the hoses 49 is separately controlled from the application of vacuum of the vacuum hoses 44. The arm 52 extends horizontally and transversely above the platform 12 from a bracket 54 which is slidably received on a pair of vertical guide shafts 56 (FIGS. 2 and 3). As best seen in FIG. 3, the upper ends of the guide shafts 56 are mounted to a bracket connected to a longitudinal channel 58 of the support frame 16, and the lower ends of the shafts are mounted to a bracket connected to a longitudinal channel 14 of the frame. The arm 52 of the suction cup assembly is reciprocatably driven by a pneumatic cylinder 60 (FIG. 1) which is vertically mounted upon a plate affixed to the lower longitudinal channel 14 (FIG. 3). A hydraulic motion controlling device, or servocylinder, 62 (FIG. 2) is provided to stop the extension of the cylinder 60 at two spaced points. A suitable servocylinder is known as a Hydrocheck and is manufactured by Bellows International, Inc. of Akron, Ohio. The servocylinder first stops the elevation of the arm 52 at an intermediate height, shown in FIG. 7, wherein the bag mouth is opened to an extent which permits the guide members 72 and 74 to be inserted into the bag mouth, and the servocylinder is also set to thereafter limit the elevation of the arm at a maximum height as shown in FIG. 8. As such maximum height, the suction cups assist in holding the bag at a fixed, longitudinal position on the guide members as the carton is pushed into the bag. Due to the additional holding force applied by the suction cups, it is not necessary to elevate the upper guide member as far merely to hold the bag in place on it and the lower guide member; thus, the possibility that the seams of the bag will be damaged by the maximum separation of the guide members for holding purposes is reduced. The control of the cylinders 60 and 62 can be by conventional pneumatic control circuitry.

After the bag mouth has been partially opened as just described, but before the guide members 72 and 74 are extended into the bag mouth, air is injected into the bag to separate the bottom and top panels of the bag. This is accomplished by a pair of air injection tubes 64 (FIGS. 1–3) which are extended longitudinally over the front end 18 of platform 12. The injection tubes are supplied with air, or other gas under pressure, by a suitable pump (not shown) with the application of air to the tubes 64 being controlled by conventional control valves. The inflation of the bag reduces the chance that the front corners of the guide members or the corners of the carton will damage the interior of the bag as such elements are extended into the bag.

Figure 6:
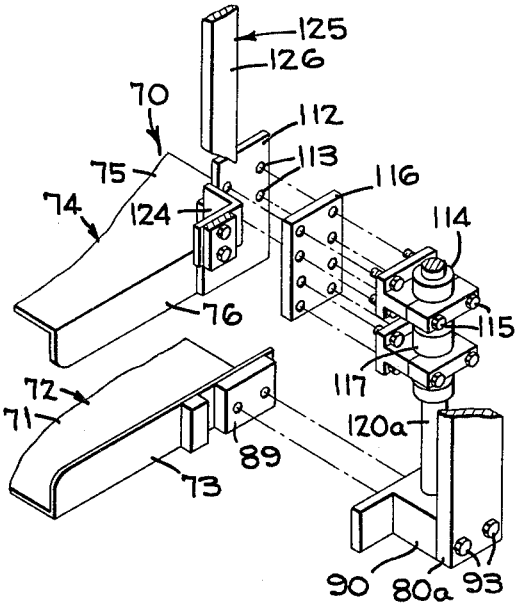
FIG. 6 is an enlarged, fragmentary, exploded isometric view illustrating the structure for detachably mounting the lower and upper guide members.

As shown in FIG. 6, the lower and upper guide members 72 and 74 of the guide assembly 70 are channel shaped and mounted in an opposing relationship to form a channel for the carton CT to be inserted into the bag BG. The lower guide member is a sheet metal structure comprised of a rectangular flat bottom wall portion 71 and flat sidewall portions 73 which are bent upwardly at right angles to the bottom wall portion. The upper guide member is a matching sheet metal part having a rectangular, flat top wall portion 75 and flat sidewall portions 76 bent downwardly from the top wall portion. The widths of the upper and lower guide members are equal and greater than the width of the carton to be bagged. The width of guide members is selected so that they are firmly engaged within the bag mouth when they are separated by a distance which is only slightly greater than the height of the carton. That is to say, the width of the guide members is correlative to the girth of the mouth of the bag such that when the upper guide member is raised by an amount only slightly greater than the height of the carton to be bagged, the bag mouth is firmly engaged on the outside surfaces of the guide members. The bag, however, is maintained in its snug engagement on the guide members by means of the suction cups 48 which pull the top of the bag upwardly.

The guide assembly 70 performs three basic functions: first, it spreads the mouth of the bag so that the carton may be pushed into the bag; second, with the assistance of the holding force applied to the top panel of the bags by the suction cup assembly 46, it firmly engages the interior of the bag mouth so that it holds the bag in place as the carton is pushed into the bag; and third, it guides the carton into the bag while supporting the carton above the platform 12 and roller conveyor 22 until the carton is fully inserted into the bag thereby assuring that the bag will not be caught between the carton and the platform or conveyor as the carton is advanced into the bag. Regarding the latter function, it will be appreciated that if the bag were caught between the heavy rigid carton and the platform or the conveyor, the interior of the bag could be damaged or the bag could be pulled from the guide members before the carton is fully inserted into the bag. To support the carton above the platform and roller conveyor, the upper guide member 74 must be so closely spaced from the top of the carton so as to bear against the top of the carton and hold it in a generally horizontal position as it is pushed into the far end of the bag where the major length of the carton is off of the supporting lower guide member 72. Thus, the guide assembly takes advantage of the rigidity of the carton in providing a means for supporting the carton until it is fully inserted into the bag. In this connection, it will be understood that the guide members 72, 74 are inserted partially into the bag to an extent such that the carton can bottom out in the bag before it drops from the lower guide member.

Figure 4:
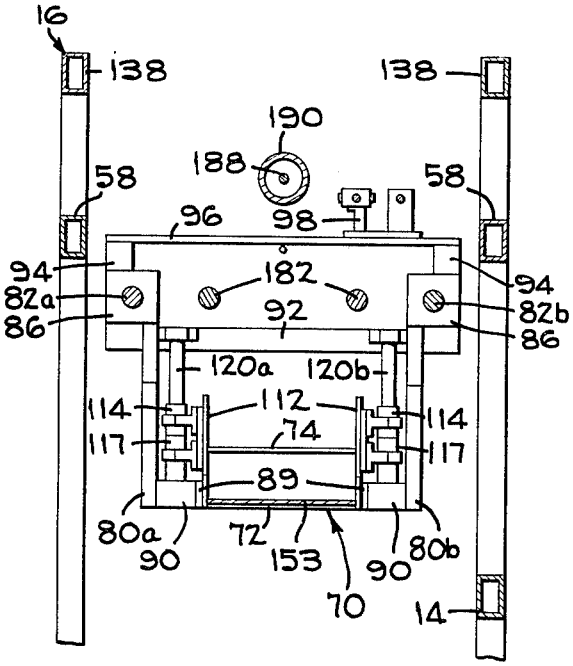
FIG. 4 is a section taken on line 4—4 of FIG. 2.

As illustrated in FIGS. 2 and 4, the guide assembly 70 includes a pair of vertically extending and transversely aligned legs 80*a* and 80*b* to which the lower guide member 72 is mounted through block members 89 and 90 (see FIG. 6). The legs 80*a* and 80*b* are slidably received upon horizontal shafts 82*a* and 82*b*, respectively, which extend over the platform 12 in a direction parallel to the platform. As best seen in FIGS. 2 and 3, each shaft 82*a*, 82*b* is mounted by brackets 83 to rails 84 and 85 that are connected transversely to the longitudinal channels 58 of the support frame 16. A bushing 86 is attached to the upper ends of each of the legs 80*a*, 80*b* to extend outwardly thereof. The bushings 86 are slidably received on the shafts 82*a*, 82*b*. A rail 92 (FIG. 4) is fastened transversely between the front ends of the bushings 86. As shown in FIG. 4, a spacer block 94 is secured to the top of each bushing, and a cross bar 96 is connected transversely between the blocks 94. It will be understood that a carriage, which is slidable on the shafts 82*a* and 82*b*, is formed by the legs 80*a* and 80*b*, the bushings 86, and the transversely extending members 92 and 96.

As shown in FIGS. 4 and 6, the lower guide member 72 is horizontally and detachably mounted between the lower ends of the legs 80*a* and 80*b*. Blocks 89 are respectively affixed to the ends of the sidewall portions 73 of the lower guide member (those ends of the sidewalls which are proximal the platform 152 on which the carton is initially received), and block members 90 are affixed between the blocks 89 and the legs 80*a*, 80*b*. The lower guide member 72 is mounted between the legs 80*a*, 80*b* by bolts 93 (FIG. 6) which extend through bores in the lower ends of the legs and the block members 90 and into threaded bores in the adjacent blocks 89.

It will be seen (from FIG. 2) that the lower guide member 72 is mounted at a height intermediate the bag platform 12 and the carton platform 152. As will be noticed from FIGS. 2 and 7, a bridging plate 153 is horizontally mounted in a fixed position between the carton platform and the bag platform at a height such that its top surface is aligned with the carton platform. An end of the plate 153 extends above the inner end of the lower guide member 72 when the guide member is in its initial position retracted from the bag mouth (FIG. 2). As will be hereinafter described, the carton is arranged to be pushed across the plate 153 and onto the lower guide member after the guide members have been inserted into the bag and have spread open the bag mouth.

The guide members 72, 74 are driven into and out of the bag by a pneumatic cylinder 100 (shown in dashed lines in FIG. 2) mounted on a support plate 102 which, in turn, is mounted to one of the rails 84 and a rail 187 extending between the channels 58 of the support frame 16. The piston of the cylinder 100 is connected to the crossbar 96 of the guide member carriage by a bracket 98. When the cylinder 100 is fully retracted, the projecting ends of the guide members are closely spaced from the mouth of the bag positioned on the platform 12 (see FIG. 2). When the cylinder 100 is fully extended, such projecting ends of the guide members are inserted into the bag to an extent such that the distance between the closed end of the bag and the guide members is approximately equal to the length of the carton.

After the guide members 72, 74 are inserted into the mouth of the bag (by appropriate timed activation of cylinder 100), the upper guide member 74 is elevated from the lower guide member 72 to spread the bag mouth to the extent that the bag is firmly engaged on the outer surfaces of the guide members. The vacuum on the apertures 40 is released at this time to permit the bottom panel of the bag to be brought up into firm engagement with the lower guide member. While the guide members are in this configuration, the carton can be pushed through the guide members with the guide members slidably supporting the carton above the platform 12 until the carton bottoms out against the closed end of the bag. In order to accomplish the elevation of the upper guide member a pair of plates 112 (see FIG. 6) are welded to the inner ends of the sidewalls of the upper guide member. The plates 112 have bores 113 formed therethrough at positions above the guide member. The retaining block of a first bushing unit 114 is attached to each plate 112 by bolts which are received in the bores 113, with a spacer plate 116 being interposed between the plate 112 and the bushing unit 114. The retaining block of another bushing unit 117 is bolted to each spacer plate 116 directly below the respective bushing unit 114. The bushing units 114, 117 are comprised of split sections which are bolted together by bolts 115 and are received on guide shafts 120*a* and 120*b* (FIGS. 4 and 6), which are respectively mounted upon the inwardly extending support block members 90 of the legs 80*a* and 80*b* so as to thus permit the upper guide member to be vertically elevated relative to the lower guide member. As shown in FIG. 4, lower ends of the guide shafts 120*a* and 120*b* are received within and supported by the block members 90 secured between the legs 80*a* and 80*b*, respectively, and the lower guide member 72. The upper ends of the shafts 120*a*, 120*b* are retained in brackets extending horizontally from the transversely extending rail 92 of the guide member carriage.

The upper guide member 74 is reciprocatably driven on the guide shafts 120*a*, 120*b* by a mechanism which can be easily adjusted to change the extent of separation of the upper guide member from the lower guide member 72 to handle cartons of differing heights. Referring to FIGS. 1, 3 and 6, it will be seen that brackets 124 are mounted to the front ends of the plates 112 that support the upper guide member and that an inverted U-shaped frame 125 is fastened to the brackets 124 so as to extend upwardly therefrom. The frame 125 includes a pair of downwardly extending bars 126 which are attached to the brackets 124 and a transverse channel 128 which is fastened between the upper ends of the bars 126. As shown in FIGS. 1 and 4, the upper guide member is initially (i.e., at the start of a bagging sequence) fully lowered on the shafts 120*a*, 120*b* such that it abuts against the lower guide member. A lift assembly 130 for elevating the upper guide member through the U-shaped frame 125 is mounted to the support frame 16 at a position situated directly over the apertures 40 in the bag supporting platform 12. The lift assembly 130 is adapted to engage the transverse channel 128 of the frame 125 when the projecting ends of the guide members have been inserted into the bag mouth. The lift assembly can then be activated to elevate the frame 125, and thus the upper guide member, to a selected height such that the mouth of the bag is fully opened and firmly positioned on the outer surfaces of the guide members. As shown in FIGS. 1, 2 and 3, the lift assembly 130 includes a pneumatic cylinder 132 which is mounted on a plate 134 that is, in turn, fastened to a pair of vertical rails 136. The lower ends of the rails 136 are connected to a cross rail 137 which extends transversely between the uppermost pair of longitudinal channels 138 of the support frame 16. A C-shaped hook 140 is attached to the lowermost end of the downwardly extending piston of the cylinder 132 so as to open horizontally in the direction of the frame 125 with the hook being contoured to complementarily receive the transverse channel 128 of the frame 125. As shown in FIG. 1, a bar 141 is mounted transversely at the upper end of the hook 140, and the piston of a servocylinder 142 (similar to the previously mentioned servocylinder 62) is connected to the end of the bar 140 (FIG. 3) to permit the limits of travel of the upper guide member to be accurately set and adjusted. The servocylinder 142 is vertically mounted on the plate 134 adjacent the pneumatic cylinder 132. As illustrated in FIG. 3, the cylinder 132 and the servocylinder 142 are mounted in a parallel manner to the support plate 134 such that when the piston in cylinder 132 is fully extended, the hook 140 will be aligned with the channel 128 and the upper guide member 74 will be in its normal, fully lowered position on the guide shafts 120*a*, 120*b* resting against the lower guide member 72. When the cylinder 100 (which drives the guide members toward the bag) is fully extended, the channel 128 of the frame 125 is inserted into the receiving channel of the hook 140. After the channel 128 is so engaged, the cylinder 132 is actuated (by conventional control means) to raise the upper guide member 74. The servocylinder 142 is set to stop the retraction of the piston within cylinder 132 when the upper guide member has been lifted to the aforementioned selected height above the lower guide member 72. The lifting distance of the upper guide member is set according to the girth of the bag mouth so as to assure that the bag mouth is fully opened and is firmly engaged on the guide members, as mentioned before. When a different carton is to be handled by the present bagging apparatus, the extent of elevation of the upper guide member can be readily changed by resetting the servocylinder 142.

As stated hereinbefore, the pusher assembly 150 is provided to push the carton CT from the platform 152 through the upper and lower guide members 74, 72 after the upper guide member has been elevated to spread open the bag mouth. The platform 152 is longitudinally aligned with the lower guide member 72, but is slightly higher than the flat transverse bottom wall 71 of the lower guide member. As best seen in FIG. 7, the bridging plate 153, which is proximal the lower guide member, extends into such guide member when the guide member is in its retracted position (the phantom outline of the guide member in FIG. 7 illustrates its retracted position). Such extension of the platform 152 by the bridging plate 153 provides support for the carton as it is pushed into the guide members.

Figure 5:
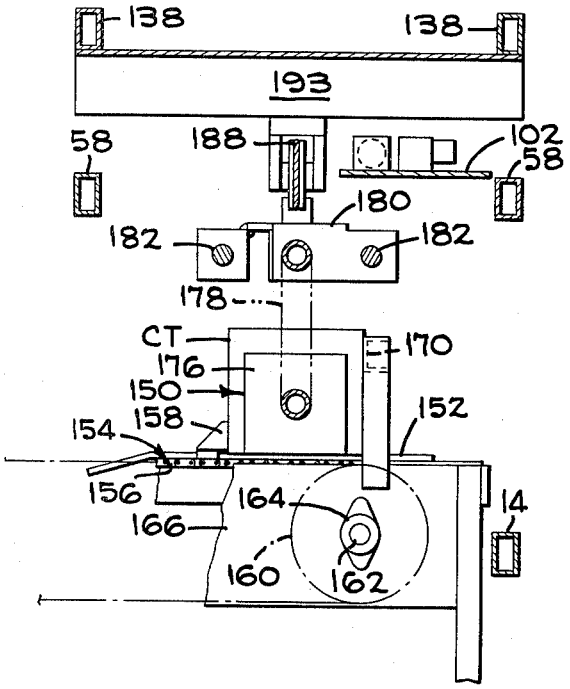
FIG. 5 is a section taken on line 5—5 of FIG. 2.

As previously indicated, cartons are sequentially fed to the platform 152 by a delivery conveyor 154 (FIG. 1) which extends transversely of the carton platform. The delivery conveyor is a conventional chain conveyor which is intermittently driven (by conventional means, not shown) to successively bring cartons into the precise position on the platform 152 when they can be pushed into the aligned bag. The delivery conveyor includes a pair of spaced parallel chains 156 having lugs 158 extending upwardly therefrom at uniform intervals. The chains 156 are entrained on sprockets 160 which are mounted on a shaft 162 (FIG. 2). The shaft 162 is received in bearings 164 which are fastened to side plates 166 extending from the support frame 16. The platform 152, as shown in FIG. 5, has a downwardly sloped section along the side which faces the delivery conveyor so as to enable the platform to lift each carton from the conveyor as the conveyor moves by the platform. A guide plate 170 (FIG. 5) is vertically positioned adjacent the opposite side of the platform 152 from the sloped edge thereof in a position directly adjacent the side of each carton when the delivery conveyor is stopped. The guide plate 170 is aligned with one set of sidewalls 73 and 76 of the guide members 72, 74 to thereby guide the carton between such guide members when the pusher assembly 150 is energized.

Figure 9:
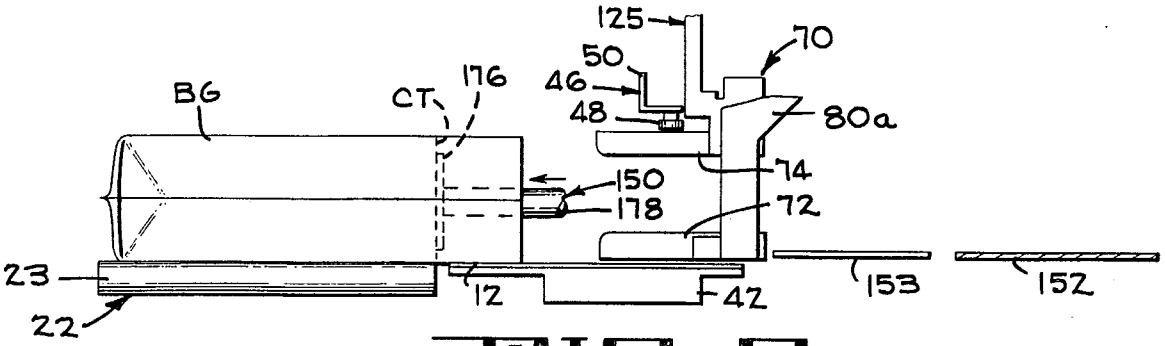

As shown in FIGS. 1 and 2, the pusher assembly 150 includes a pusher plate 176 which is vertically mounted at the end of a U-shaped tubular structure 178. The tubular structure 178 depends from a carriage 180 which is slidingly received on a pair of parallel shafts 182 that extend longitudinally above the platform 152 and the platform 12 between the shafts 82*a* and 82*b* (FIG. 3). The ends of shafts 182 are supported by brackets 184 (FIG. 2) which are respectively connected to rails 186 and 187 which extend transversely between the channels 58 of the support frame 16. A cable cylinder 190 is suspended from rails 191 and 193 (FIG. 2) which extend transversely between the uppermost channels 138 of the support frame. The cables 188 of the cable cylinder 190 are connected by a bracket 192 to the top of the carriage 180, as shown in FIG. 2. Thus, activation of the cable cylinder will cause the carriage 180 to be moved along the shafts 182 to urge the pusher plate 176 between the solid line position and the phantom line position shown in FIG. 2. The retraction of the carriage to the upstream start position, after pushing a carton into a bag, is set by a conventional shock-absorbing stop device (not shown) so as to stop the carriage at a position where the plate 176 is spaced upstream from the platform 152 as shown in FIG. 2. The extension of the pusher plate 176 in the downstream direction is controlled by a stop device 194 (FIG. 2) which engages the carriage 180 after the carton has been pushed through the guide members 72, 74 into the bag and the bag and carton have been pushed onto the take-away conveyor 22, as shown in FIG. 9. By means of conventional control circuitry, the cable cylinder 190 is operated alternately with the delivery conveyor 154 so that the cable cylinder operates through one complete cycle while the conveyor 154 is stopped.

A brief summary of the operation of the bagging apparatus 10 will now be provided in connection with FIGS. 7–9. To start the bagging sequence, a flat empty thermoplastic bag BG is placed on the platform 12 in a position such that the bag extends longitudinally across the rear end of the platform 12 onto the rollers of the take-away conveyor 22 and such that the mouth of the bag is closely spaced from the ends of the air injection tubes 64 (FIG. 1). While the bag is being delivered into position the delivery conveyor 154 is actuated to move a carton CT onto the platform 152. The cylinder 60 of the suction cup assembly 46 is then actuated to fully lower the arm 52 of the suction cup assembly to a position such that the suction cups 48 are compressed against the top panel of the bag, and vacuum is applied through the hoses 44 to the apertures 40 to hold the bottom panel of the bag against the platform 12. Vacuum is then applied to the hoses 49, and thus the suction cups 48, to enable the suction cups to grip the top panel of the bag, and the cylinder 60 is energized to elevate the arm 52 of the suction cup assembly 46 with the associated servocylinder 62 automatically stopping the elevation at a selected height (as shown in FIG. 7) such that the mouth of the bag is partially opened. The bag is thereafter inflated by injecting air through the tubes 64, and, as indicated hereinbefore, the injection of the air spreads the panels of the bag to the extent that the carton may be later inserted therein without damaging the interior of the bag.

As shown in FIG. 2, the cylinder 100 which drives the legs 80*a* and 80*b* is initially retracted such that the guide members 72 and 74 are spaced from the mouth of the bag. By actuating the cylinder 100, the upper and lower guide members are driven into the partially opened mouth of the bag to the position shown in FIG. 7. At this point the channel 128 of the U-shaped frame 125 attached to the upper guide member 74 is engaged within the hook member 140 of the lift assembly 130.

Next, and as depicted in FIG. 8, the cylinder 132 is actuated to elevate the hook member 140 and thus the upper guide member moves along the vertical path of the shafts 120*a*, 120*b*. Simultaneously with the activation of the cylinder 132, the cylinder 60 is actuated so that the suction cups 48 will also be raised as the upper guide member is raised. The servocylinders 142 and 62 are set so that the rates of movement of the pistons of cylinders 132 and 60, respectively, will be the same. The retraction of the guide member lifting cylinder 132 is stopped by the servocylinder 142 at a height (FIG. 8) such that the upper guide member has spread the bag mouth and caused the bag to be firmly engaged on the outer surfaces of guide members thereby forming a bag opening only slightly larger than the cross-section of the carton. The vacuum in apertures 40 is released prior to the lifting movement of the upper guide member to along the bag to conform to the bottom surface of the lower guide member.

Finally, as depicted in FIG. 9, the cable cylinder 190 of the pusher assembly 150 is actuated to pull the carriage 180 along the shafts 182 and thereby drive the pusher plate 176 against the end of the carton. The carton is forced through the opened guide members 72 and 74, with such guide members directing the carton properly into the bag and supporting the carton above the platform 12 until after the carton has been substantially fully inserted into the bag. At or just prior to the time that the carton has been forced into the bag against the closed end thereof, the vacuum to the suction cups 48 is removed so that the pusher plate will continue to push the carton and the freed bag to the extent that the bag is pushed onto the take-away conveyor 22. That is to say, the pusher assembly 150 pushes the carton through the guide members into the bag and thereafter continues to push the carton until the bag has been stripped from the outer surfaces of the guide members finally forcing the filled bag off the platform 12 and onto the rollers of the take-away conveyor. The conveyor 22 may then be actuated to carry the filled bag from the bagging apparatus while the pusher assembly 150 and cylinder 100 are retracted prior to the initiation of the next bag filling cycle.

Although the best mode contemplated for carrying out the present invention has been shown and described herein, it will be apparent that modification and variations may be made without departing from what is regarded to be the subject matter of the invention.

What is claimed is:

1. An apparatus for inserting an article into a flexible bag comprising:

means for supporting a bag in a flat selected orientation;

means mounted adjacent one end of said bag supporting means for partially opening the mouth of said bag;

means for supporting the article to be bagged in a position which is closely spaced from said bag mouth and in an orientation which is longitudinally aligned with said bag;

means for pushing the article from said article supporting means and into said bag mouth; and means for fully opening said bag mouth and for thereafter guiding the article into the bag while holding said bag in a fixed position, said last-named means including a lower guide member having a channel configuration for slidably receiving the bottom of the article as it is pushed from said article supporting means, carriage means for supporting said lower guide member for movement along a path of travel which is longitudinally aligned with said bag supporting means with said lower guide member being mounted to said carriage means such that its bottom wall is at a level above said bag supporting means, means for retractably moving said carriage means from an initial position where the outer end of said lower guide member which is proximal said bag supporting means is spaced from the mouth of said bag to an extended position where said outer end is inserted into said bag, an upper guide member for slidably engaging the upper portion of the article, means for mounting said upper guide member to said carriage means directly above said lower guide member for movement along a path of travel of said lower guide member, said lower and upper guide members being receivable in the mouth of a bag which has been partially opened by said bag mouth opening means and means for elevating said upper guide member after both the upper and lower guide members have been inserted into said bag by said carriage means, said guide members being sufficiently long relative to the length of the article to support the leading end of the article above said bag supporting means until the article is substantially fully inserted into said bag by said pushing means, said elevating means including frame means rigidly mounted to and extending upwardly from said upper guide member, drive means initially remotely positioned from said frame means when said carriage means is in said initial position, and said drive means including means for engaging said frame means when said carriage means has been moved to its extended position where said lower and upper guide members are inserted into said bag.

2. The apparatus according to claim 1 wherein said drive means of said elevating means is adjustable so as to elevate said upper guide member to a selected, variable height above said lower guide member, whereby said apparatus may be adjusted to accommodate articles of different heights.

3. An apparatus for inserting an article into a flexible bag comprising:

means for supporting a bag in a flat selected orientation;

means mounted adjacent one end of said bag supporting means for partially opening the mouth of said bag;

means for supporting the article to be bagged in a position which is closely spaced from said bag mouth and in an orientation which is longitudinally aligned with said bag;

means for pushing the article from said article supporting means and into said bag mouth; and means for fully opening said bag mouth and for thereafter guiding the article into the bag while holding said bag in a fixed position, said last-named means including a lower guide member having a channel configuration for slidably receiving the bottom of the article as it is pushed from said article supporting means, carriage means for supporting said lower guide member for movement along a path of travel which is longitudinally aligned with said bag supporting means with said lower guide member being mounted to said carriage means such that its bottom wall is at a level above said bag supporting means, means for retractably moving said carriage means from an initial position where the outer end of said lower guide member which is proximal said bag supporting means is spaced from the mouth of said bag to an extended position where said outer end is inserted into said bag, an upper guide member for slidably engaging the upper portion of the article, means for mounting said upper guide member to said carriage means directly above said lower guide member for movement along a path of travel which is normal to said longitudinal path of travel of said lower guide member, said lower and upper guide members being receivable in the mouth of a bag which has been partially opened by said bag mouth opening means and means for elevating said upper guide member after both the upper and lower guide members have been inserted into said bag by said carriage means, said guide members being sufficiently long relative to the length of the article to support the leading end of the article above said bag supporting means until the article is substantially fully inserted into said bag by said pushing means, said means for initially partially opening the mouth of said bag comprising means embodied in said bag supporting means for releasably engaging the bottom panel of the bag, suction cup means for releasably engaging the top panel of the bag, means for elevating said suction cup means, and means for stopping said suction cup elevating means at a first height such that said guide members may be inserted into the bag and for subsequently stopping said suction cup elevating means at a second height such that said suction cup means continues to engage said top panel of the bag when said upper guide member is fully elevated within said bag thereby assisting in holding the bag on the guide members as the article is inserted through the guide members into the bag.

4. The apparatus according to claim 3 and further comprising conveyor means for receiving the bag after the article has been inserted therein, said conveyor means being positioned adjacent the end of said bag supporting means which is distal from said article supporting means, said pushing means being adapted to continue to push the article after it has been fully inserted into said bag until the article pulls the bag from the guide members and the bagged article is moved across said bag supporting means onto said conveyor means.

* * * * *